US006184840B1

(12) United States Patent
Hsin-Loug et al.

(10) Patent No.: US 6,184,840 B1
(45) Date of Patent: Feb. 6, 2001

(54) PARABOLIC REFLECTOR ANTENNA

(75) Inventors: Lin Hsin-Loug, Hsinchu; Lee Ta-Lun, Taoyuan, both of (TW)

(73) Assignee: SmartAnt Telecomm Co., Ltd. (TW)

( * ) Notice: Under 35 U.S.C. 154(b), the term of this patent shall be extended for 0 days.

(21) Appl. No.: 09/517,069

(22) Filed: Mar. 1, 2000

(51) Int. Cl.[7] ..... H01Q 19/18

(52) U.S. Cl. ..... 343/781 P; 343/781 R; 343/781 GA

(58) Field of Search ..... 343/781 P, 781 GA, 343/781 R, 837, 840; H01Q 15/02, 19/18

(56) References Cited

U.S. PATENT DOCUMENTS 4,581,615 * 4/1986 Levy ..... 343/781 P 6,107,973 * 8/2000 Knop et al. ..... 343/781 P

* cited by examiner

*Primary Examiner*—Hoanganh Le

(74) *Attorney, Agent, or Firm*—Birch, Stewart, Kolasch & Birch, LLP

(57) ABSTRACT

This specification discloses a parabolic reflector antenna, which is used as an antenna for signal transmission between the radio communication base station and the mobile terminals. By determining the curvatures and relative positions of a main-dish with a main reflecting surface and a sub-dish with a sub-reflecting surface and means of determining the size of the feedback device and relevant distances in between, the present invention improves the signal reception and emission of the parabolic reflector antenna.

17 Claims, 4 Drawing Sheets

PARABOLIC REFLECTOR ANTENNA

BACKGROUND OF THE INVENTION

1. Field of the Invention

The present invention relates to a parabolic reflector antenna and, more particularly, to a parabolic reflector antenna for signal transmission between the radio communication base station (BS) and the mobile terminals.

2. Related Art

The parabolic reflector antenna is a high gain antenna with orientation that is mostly used in radar systems, microwave systems and satellite systems. Its reflector is shaped into one that can readily collect radio signals. It is also termed open antenna. Since the dimension of the reflector is much larger than the signal wavelength, so it can be applied to electromagnetic radiation. The parabolic reflector antenna comprises two main components: one is a parabolic reflector and the other is a feedback active unit. Basically, the active unit is the original antenna for signal feedback. Usually, the electromagnetic energy is directed toward the reflector using dipoles, dipole arrays, and waveguides. The reflector is a passive device with no power. It is solely used to focus and direct the electromagnetic energy supplied from the original antenna by reflecting and to spread the energy into space.

The parabolic reflector is a dish disk, so it is also called the dish antenna. The function principle of the parabolic reflector can be elucidated in terms of the geometric properties of parabolas. Please refer to FIG. 1. In the x-y coordinate system, a parabolic curve can be expressed by $$y^2=4fx, \tag{1}$$

where f is the distance from the parabolic vertex to the focus F of the parabola. According to the geometric characters of parabolas, the sum of the distances from any point (such as A, B and C) on the parabola to the focus F and to points on the line $y_1-y_2$ parallel to the directrix is a constant. That is, $$FA+AA'=FB+BB'=FC+CC'=K, \tag{2}$$

where K is a constant. The parabolic reflector is a disk-like curved surface formed by rotating a parabola about the x-axis, which is called the paraboloid. The paraboloid is often used in car headlights for focusing light. If the electromagnetic energy is radiated from the focus F and reflected by the parabolic reflector, all simultaneously emitted radiation wave fronts reach the line $Y_1-Y_2$ at the same time. The distances traveled by all waves are equal, and the wave shapes and phases on this line are the same. Therefore, this reflector can focus the electromagnetic energy into a beam along the x-axis and form a high gain directional radiation.

In particular, the feedback device of the parabolic reflector antenna is the actual supplier of electromagnetic energy radiation, and is thus called the primary antenna. The primary antenna is positioned on the focus of the parabolic reflector for obtaining the best emission or reception effects. Aside from dipole antenna, the primary antenna often uses waveguides to form a horn feed in the microwave frequencies.

SUMMARY OF THE INVENTION

It is a major object of the present invention to provide a parabolic reflector antenna that functions as a good signal transmission terminal between the radio communication base station and mobile terminal devices.

The parabolic reflector antenna includes a first cover and a second cover, a main-dish with a main reflecting surface, a sub-dish with a sub-reflecting surface, and a feedback device. By determining the preferred curvatures and relative positions of the main-dish and the sub-dish, means for determining the size of the feedback device and relevant distances in between, and defining all the parameters of both the parabola in the main reflecting surface and the hyperbola in the sub-reflecting surface, the present invention determines preferred shapes for the main-dish and sub-dish so as to provide a parabolic reflector antenna with better signal reception and emission effects.

Furthermore, the parabolic reflector antenna disclosed in this invention provides a feedback device with a square horn waveguide and a circular horn waveguide connecting together for converting the signals from the signal source in electrical communication with the square horn waveguide to electromagnetic radiation in the circular horn waveguide.

The present invention fixes the sub-dish with the sub-reflecting surface onto the first cover using a screw, which can conveniently adjust the position of the whole sub-dish.

The first cover and the second cover include a convex rim portion and a concave rim portion, respectively. They are combined by ultrasonic wave welding and are thus beautiful and waterproof.

Moreover, the feedback device is fabricated by covered injection molding and combined with the second cover using ultrasonic wave welding. Therefore, it is easy to manufacture and is waterproof.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow illustration only, and thus are not limitative of the present invention, and wherein.

DETAILED DESCRIPTION OF THE INVENTION

In general, the design parameters of an antenna according to the application include: the range of frequencies, the half-power beamwidth (HPBW) on the E-plane and H-plane, the voltage standing wave ratio (VSWR), the form of the connector, and the antenna gain. By varying these parameters, one can design the antenna structure desired.

Figure 3:
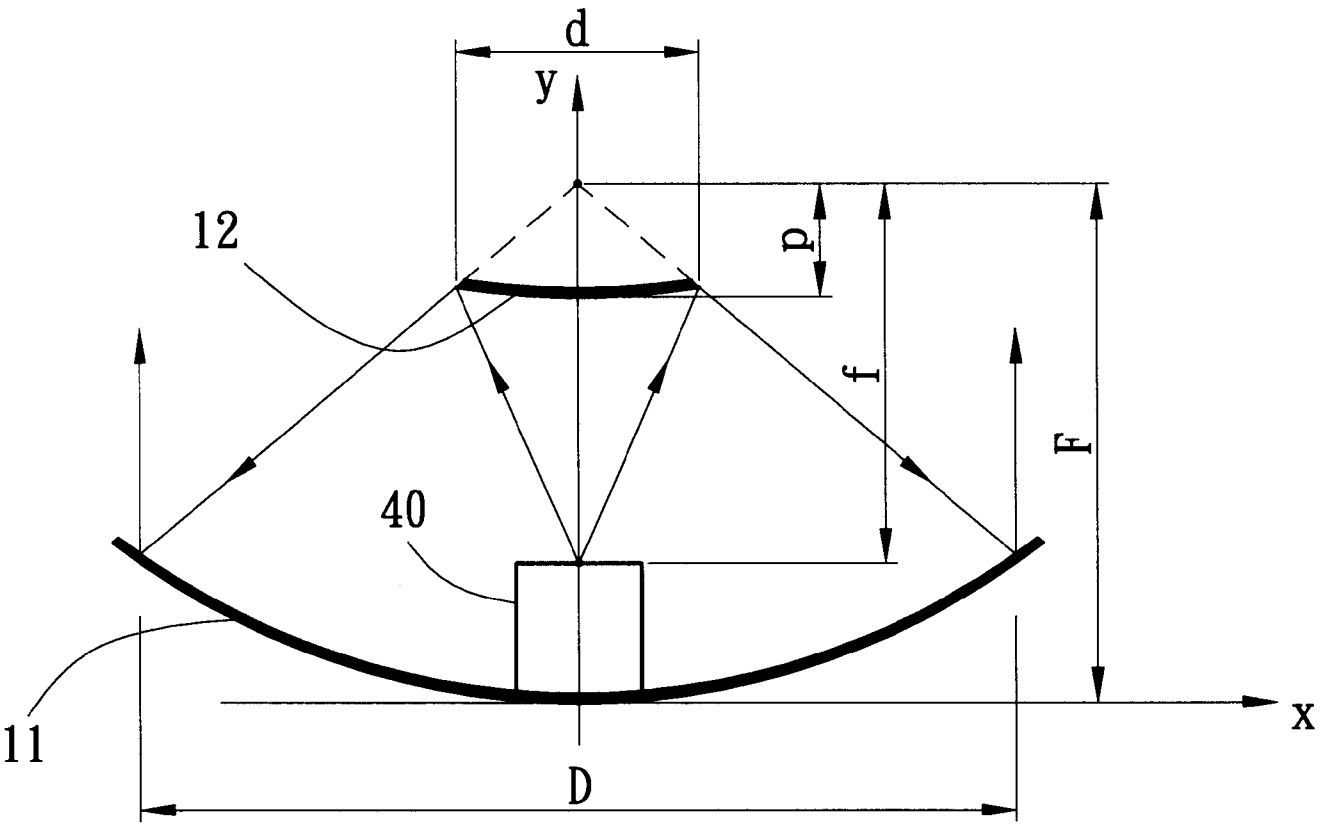
FIG. 3 is a schematic view about how the parabolic reflector antenna functions according to the present invention.

Please refer to FIG. 3, which is a schematic view about how the parabolic reflector antenna functions according to the present invention. The parabolic reflector antenna comprises a main reflecting surface 11 and a sub-reflecting surface 12, wherein the main reflecting surface 11 and the sub-reflecting surface 12 share the same axis. To reduce the electromagnetic screening caused by the power supply cord of the feedback device 40 and to preventing shrinking the antenna blocking, the sub-reflecting surface 12 formed by rotating a hyperbola is prepared as a high gain communication antenna. Furthermore, although it is expected to have all electromagnetic waves from the feedback device 40 and the sub-reflecting surface 12 reflected to the main reflecting surface, nevertheless, an extremely small amount leaks out of the end. This leakage is called spillover, which may lower the antenna gain and side lobes.

Figure 1:
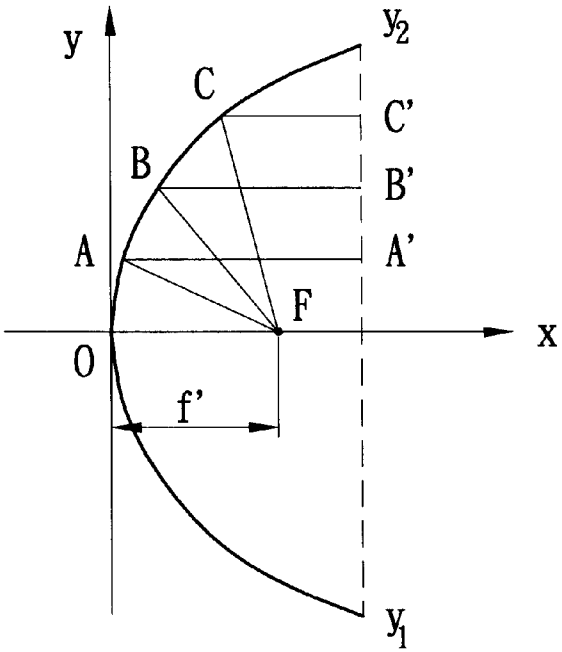
FIG. 1 (PRIOR ART)
FIG. 1 is a diagram showing the geometric properties of a parabola.
Figure 2:
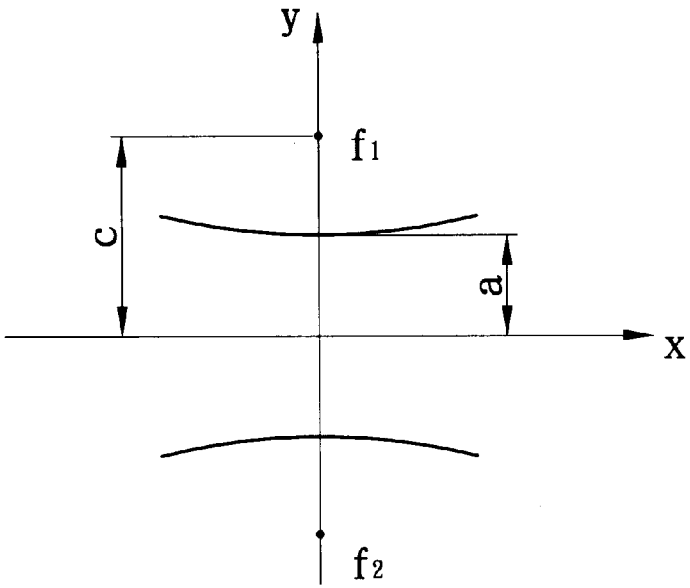
FIG. 2 (PRIOR ART)
FIG. 2 is a diagram showing the geometric properties of a hyperbola.

The main reflecting surface 11 is a parabola whose vertex is sitting at the origin of the coordinate system. The focus is on the y-axis at a distance F from the origin. The parabolic curve can be expressed in terms of the function $$y = \frac{1}{4F}x^2,$$

and the diameter of the main reflecting surface 11 is D. The sub-reflecting surface 12 us one of the hyperbolic curves with the center and vertices on the y-axis. It is determined by the formula $$\frac{y^2}{a^2} - \frac{x^2}{b^2} = 1$$

and the diameter of the sub-reflecting surface 12 is d. The hyperbolic curve has an internal focus and an external focus, wherein the internal focus is identical to the focus of the parabolic surface and the external focus is at the center of the signal emitter/receiver of the feedback device 40. The distance between the internal focus and the external focus is f, and the distance from the parabolic focus to the sub-reflecting surface is p. According to the geometric properties of hyperbolas (referring to FIG. 2), if the distances from the center to either vertex and to the foci f1, f2 are a and c, respectively, then $$f=2c, \tag{3}$$

$$p=c-a. \tag{4}$$

The relation among a, b, and c is $$c^2=a^2+b^2. \tag{5}$$

Therefore, c can be determined once a and b arc known, which can then be used to calculate f and p.

Furthermore, the distance F between the main reflecting surface 11 and the focus can also be determined from the F/D ratio. In general, F/D is between 0.3 and 0.4, and the value 0.4 is more proper for a higher antenna gain. Once the diameter D of the main reflecting surface 11 is determined, one can readily get the focus F; that is, one can get the formula for the parabola and from which deduce the parabolic shape.

The signal sent out from the feedback device 40 is first emitted to the sub-reflecting surface 12. This signal is reflected by the hyperbolic curve to propagate along the extended direction from the internal focus to the reflecting point and reaches the main reflecting surface 11. The signal that arrives at the main reflecting surface 11 is further reflected to propagate outwards parallel to the y-axis. This achieves the goal of signal emission. On the other hand, the signal from a distance can be received by the feedback device 40 by following the same path but in reversed direction. Therefore, this parabolic reflector antenna can emit and receive signals.

Figure 4:
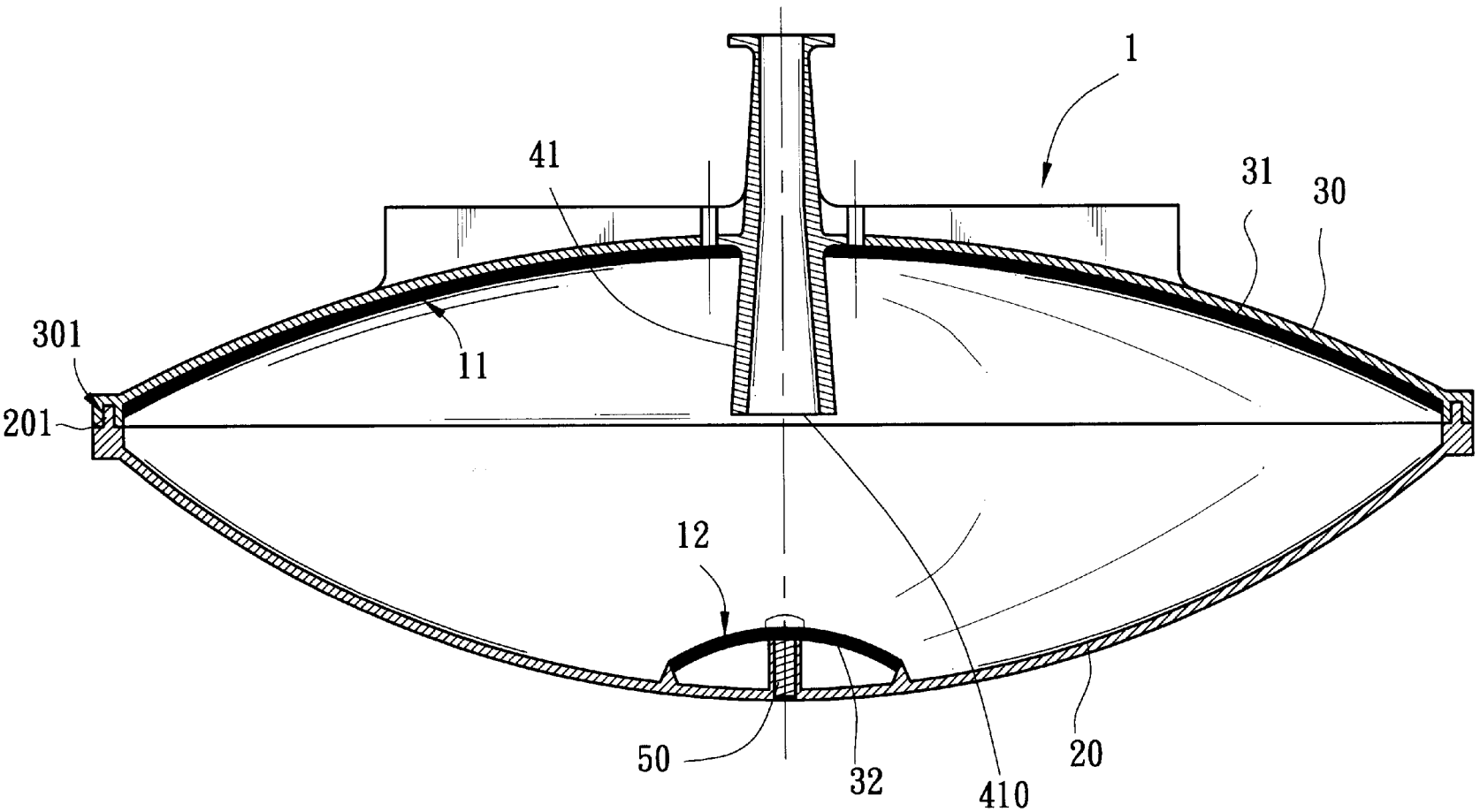
FIG. 4 is a cross-sectional view of the structure of the parabolic reflector antenna according to the present invention.

Referring to FIG. 4, which gives a cross-sectional view of the structure of the parabolic reflector antenna according to the present invention, the parabolic reflector antenna 1 comprises a first cover 20, a second cover 30, a main-dish 31, a sub-dish 32 and a feedback device 41, such as the horn feed.

The first cover 20 and the second cover 30 have a radome shape and are made by ABS. They have a convex rim 201 and a concave rim 301, respectively. The first cover convex rim 201 and the second cover concave rim 301 are combined by ultrasonic wave welding. The welding is waterproof and provides a better appearance than the conventional glue binding.

The main-dish 31 is formed within the second cover 30 and is made by tin. It contains a main reflecting surface 11 defined by the formula $$y = \frac{1}{4F}x^2$$

and a focus. The focus value F is determined by the F/D ratio as described before. Usually, F is between 75 mm and 100 mm.

The sub-dish 32 is connected to the interior of the first cover 20 using a screw 50 and is made by tin. It contains a sub-reflecting surface 12 defined by the formula $$\frac{y^2}{a^2} - \frac{x^2}{b^2} = 1,$$

an internal focus and an external focus. The internal focus coincides with the parabolic focus. Normally, a is between 11 mm and 25 mm, b is between 24 mm and 36 mm. The value c can be determined from a and b as described hereinbefore, which is then used to determine both f and p. The material of the screw 50 is polycarbonate (PC). In addition to installing and fixing the sub-dish 32 onto the first cover 20, the action of the screw 50 is also to adjust the position of the sub-dish 32 so that the internal focus of the sub-reflecting surface 12 coincides with the focus of the main reflecting surface 11.

The horn feed 41 is connected to the second cover 30. They are preferably connected together in an embodiment of the present invention. The material aluminum (Al) is shaped into a horn feed 41 by metal injection molding, which is then welded with the second cover 30 made by ABS by ultrasonic waves. This method has such advantages as simple manufacturing and waterproof protection. In addition, the horn feed 41 comprises a square horn waveguide and a circular horn waveguide. A signal emitter/receiver 410 is provided at the opening of the circular horn waveguide for receiving and emitting signals. The center of the signal emitter/receiver 410 coincides with the external focus of the hyperbolic surface. One end of the square horn waveguide is connected to a gauged coaxial waveguide connector WR34 or WRJ260, whose size is 4.318 mm*8.636 mm. It is in electrical communication with a signal source (not shown) for converting the signal in the square horn waveguide into the electromagnetic radiation in the circular horn waveguide. The preferred dimension and distances among components of the horn feed 41 are: the length of the horn feed 41 is between 40 mm and 80 mm; the diameter of the emitter/receiver 410 is between 18 mm and 30 mm; the emitter/receiver 410 is 36 mm to 40 mm over the second cover 30; and the distance between the emitter/receiver 410 and the sub-dish 32 is between 36 mm and 46 mm.

Therefore, the dimension and efficiency of the horn feed 41 is first considered when designing. Once they are determined, the parameters such as a, b, and the diameter d of the sub-dish 32 and the diameter D of the main-dish 31 can be determined as described hereinbefore. With the relation among them, one can readily obtain the optimized design in sizes.

The order of assembly is as follows: The location of the main reflecting surface 11 and its focus is first determined. The value (F-f) determines the length that the horn feed 41 is over the main reflecting surface 11. This is done at the same time while manufacturing. The sub-reflecting surface 50 is installed at the position with a distance (f-p) from the center of the emitter/receiver 410 of the horn feed 41 using a screw 50. A precise positioning can be obtained by adjusting the screw 50 so that the internal focus of the sub-reflecting surface 12 coincides with the focus of the main reflecting surface 11. This completes the installation steps of the whole parabolic reflector antenna 1.

Figure 5:
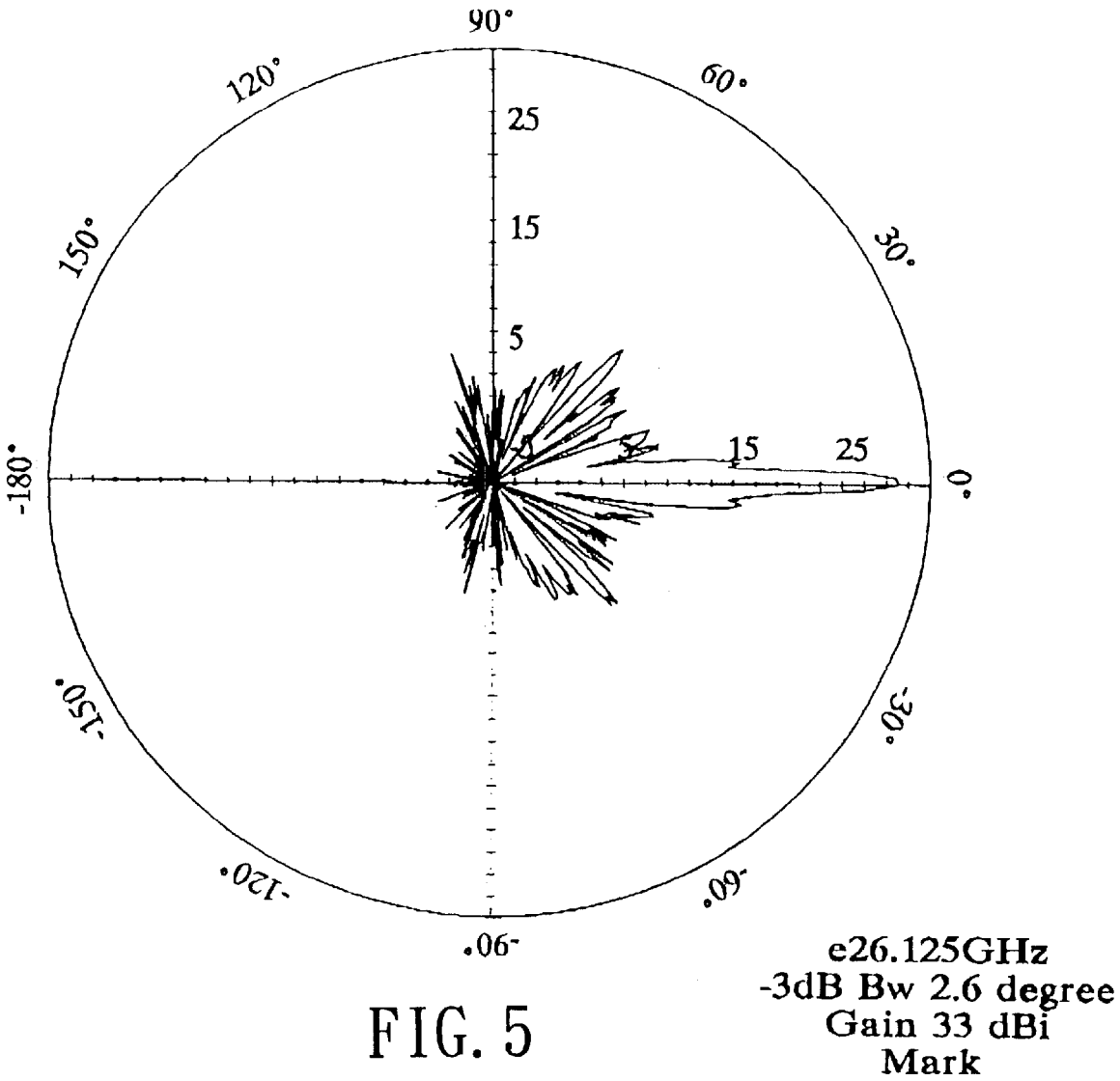
FIG. 5 is a diagram showing the orientation of the parabolic reflector antenna according to the present invention.

FIG. 5 is a diagram showing the experimental measurement of the orientation of the parabolic reflector antenna according to the present invention. When the work frequency is 26.125 GHz, the angle subtended by the −3 dB bandwidth is 2.6 degrees. Therefore, it is a highly oriented antenna. It is also a high gain antenna with a gain of 33 dBi.

The parabolic reflector antenna of the present invention achieves the following effects:

1. It provides an antenna structure with a high gain. This antenna structure can not only be applied to the communication antenna in mobile phones, but also to all other radio communication systems, such as in the local multi-point delivery service (LMDS).
2. It provides a feedback device with a square horn waveguide and a circular horn waveguide connecting together for converting the signals from the signal source in electrical communication with the square horn waveguide to electromagnetic radiation in the circular horn waveguide.
3. The position of the sub-dish can be easily adjusted with a high precision by using a screw to fix the sub-dish with the sub-reflecting surface to the first cover.
4. The convex rim of the first cover and the concave rim of the second cover are combined by ultrasonic wave welding. It has such advantages as a better appearance and waterproof protection.
5. The feedback device is formed by metal injection molding and combined with the second cover made of ABS by ultrasonic welding. It has such advantages as simple manufacturing and waterproof protection.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A parabolic reflector antenna, comprising:

a first cover;

a second cover;

a main-dish, which is connected to the interior of the second cover and contains a main reflecting surface defined by the formula $$y = \frac{1}{4F}x^2$$

and a focus F, the F value being between 75 mm and 100 mm;

a sub-dish, which is connected to the interior of the first cover and contains a sub-reflecting surface defined by the formula $$\frac{y^2}{a^2} - \frac{x^2}{b^2} = 1,$$

an internal focus and an external focus, the internal focus coinciding with the parabolic focus, a being between 11 mm and 25 mm, and b being between 24 mm and 36 mm; and a feedback device, which is connected to the second cover and contains a signal emitter/receiver in electrical communication with a signal source for electromagnetic radiation, the center of the signal emitter/receiver coinciding with the hyperbolic external focus.

2. The antenna according to claim 1, wherein the material of the first cover and the second cover is ABS.

3. The antenna according to claim 1, wherein a convex rim is formed on the first cover and a concave rim is formed on the second cover.

4. The antenna according to claim 3, wherein the convex rim of the first cover and the concave rim of the second cover are combined by ultrasonic wave welding.

5. The antenna according to claim 1, wherein the feedback device is combined with the second cover.

6. The antenna according to claim 5, wherein the feedback device and the second cover are combined by ultrasonic wave welding.

7. The antenna according to claim 1, wherein the sub-dish is connected to the first cover using a screw.

8. The antenna according to claim 7, wherein the material of the screw is polycarbonate (PC).

9. The antenna according to claim 1, wherein the material of the main-dish is tin.

10. The antenna according to claim 1, wherein the material of the sub-dish is tin.

11. The antenna according to claim 1, wherein the feedback device is a horn feed.

12. The antenna according to claim 11, wherein the horn feed comprises a square horn waveguide and a circular horn waveguide connecting together for converting the signals from the signal source in electrical communication with the square horn waveguide to electromagnetic radiation in the circular horn waveguide.

13. The antenna according to claim 11, wherein the material of the horn feed is aluminum (Al).

14. The antenna according to claim 11, wherein the diameter of the signal emitter/receiver of the horn feed is between 18 mm and 30 mm.

15. The antenna according to claim 11, wherein the length of the horn feed is between 40 mm and 80 mm.

16. The antenna according to claim 11, wherein the signal emitter/receiver of the horn feed is over the second cover by a length between 36 mm and 40 mm.

17. The antenna according to claim 11, wherein the distance between the horn feed and the sub-dish is between 36 mm and 46 mm.

* * * * *